US011800893B2

(12) United States Patent
Artz

(10) Patent No.: US 11,800,893 B2
(45) Date of Patent: Oct. 31, 2023

(54) CHILLING WATER PIPE AND METHOD OF USE

(71) Applicant: Samuel Oliver Artz, Lake Stevens, WA (US)

(72) Inventor: Samuel Oliver Artz, Lake Stevens, WA (US)

( * ) Notice: Subject to any disclaimer, the term of this patent is extended or adjusted under 35 U.S.C. 154(b) by 25 days.

(21) Appl. No.: 15/985,509

(22) Filed: May 21, 2018

(65) Prior Publication Data

US 2018/0332891 A1 Nov. 22, 2018

Related U.S. Application Data

(60) Provisional application No. 62/509,039, filed on May 19, 2017.

(51) Int. Cl.
*A24F 1/30* (2006.01)
*A24F 1/08* (2006.01)
(Continued)

(52) U.S. Cl.
CPC ..... *A24F 1/30* (2013.01); *A24F 1/06* (2013.01); *A24F 1/08* (2013.01); *A24F 1/10* (2013.01); *A24F 1/32* (2013.01); *A24F 1/22* (2013.01)

(58) Field of Classification Search
CPC ..... A24F 1/00; A24F 1/02; A24F 1/08; A24F 1/10; A24F 1/14; A24F 1/30; A24F 1/22; A24F 3/00; A24F 3/02; B65D 81/3872
(Continued)

(56) References Cited

U.S. PATENT DOCUMENTS 3,755,030 A * 8/1973 Doman ..... B29C 65/0672 156/73.5
4,029,109 A * 6/1977 Kahler ..... A24F 1/30 131/173
(Continued)

FOREIGN PATENT DOCUMENTS

GB 438175 * 1/1935 ..... A24F 1/30
GB 438175 A * 11/1935 ..... A24F 1/30
(Continued)

OTHER PUBLICATIONS

Gchem, "Heat Capacities for Some Select Substances", gchm.cm.utexas.edu, Accessed Aug. 11, 2020. (Year: 2020).*
(Continued)

*Primary Examiner* — Philip Y Louie
*Assistant Examiner* — Sonny V Nguyen
(74) *Attorney, Agent, or Firm* — Bold IP, PLLC; Christopher Mayle

(57) ABSTRACT

A water pipe that cools down smoke or vapor in a water pipe or other smoking apparatus for the user. The water pipe includes a base having an extended bottom surface, a base insert and a top assembly, whereby the top assembly includes a downstem and a mouthpiece. A cooling solution is poured into the base container and the base insert is bonded or otherwise coupled to the base container such that the cooling solution remains in between the base container and base insert. The water pipe is put in a freezer or cooling source for a specified amount of time, and thereafter the base insert is filled with water. Once filled with water, the top assembly is inserted on top of the base insert. Tobacco, medicinal herbs, and/or oils are placed in a bowl or other apparatus connected to the downstem with one end submerged in water and one end exposed to ambient air. As the
(Continued)

smoke or vapor percolates and passes through the water pipe the smoke or vapor is cooled down.

10 Claims, 5 Drawing Sheets

(51) Int. Cl.
*A24F 1/10* (2006.01)
*A24F 1/32* (2006.01)
*A24F 1/06* (2006.01)
*A24F 1/22* (2006.01)

(58) Field of Classification Search
USPC ..... D27/162–169, 180–182
See application file for complete search history.

(56) References Cited

U.S. PATENT DOCUMENTS 4,036,240 A * 7/1977 Murray, Jr. ..... A24F 1/30 131/173
4,164,950 A * 8/1979 Bechtold ..... A24F 1/22 131/173
4,187,885 A * 2/1980 Kahler ..... A24F 1/30 220/259.3
4,198,993 A * 4/1980 Martin ..... A24F 1/30 131/173
5,400,807 A * 3/1995 Newman ..... A24F 1/30 131/173
5,738,116 A * 4/1998 Truelove ..... A24F 1/30 131/173
6,453,908 B1 * 9/2002 Caballero ..... A24F 1/30 131/173
7,287,530 B1 * 10/2007 Stuart ..... A24F 1/30 131/173
9,848,639 B1 * 12/2017 Soares ..... A24F 1/02
2008/0072917 A1 * 3/2008 Lee ..... A24F 1/30 131/173
2013/0221013 A1 * 8/2013 Kolowich ..... B65D 81/3872 220/592.17
2014/0326256 A1 * 11/2014 McKay ..... A24F 1/30 131/173
2015/0181931 A1 * 7/2015 Hoover ..... A24F 1/30 131/260
2016/0031630 A1 * 2/2016 Malaspino ..... A47G 19/027 220/574.2
2016/0165951 A1 * 6/2016 Gupta ..... A24F 40/50 131/329
2016/0295911 A1 * 10/2016 Kalousek ..... A24F 1/30
2018/0020719 A1 * 1/2018 Rives ..... F16L 17/02 131/173
2018/0213840 A1 * 8/2018 Bavar ..... A24F 1/32
2018/0263280 A1 * 9/2018 Camitta ..... A24F 1/30
2018/0317544 A1 * 11/2018 Hagen ..... A24F 1/30

FOREIGN PATENT DOCUMENTS

GB 2383122 A * 6/2003 ..... F25D 3/08
KR 20090115349 A * 11/2009

OTHER PUBLICATIONS

Casalex, "Ents! What do you think of my bong design?," May 30, 2012, Reddit.com, <https://www.reddit.com/r/trees/comments/ud9yj/ents_what_do_you_think_of_my_bong_design/>. (Year: 2012).*
SheeCool "SheeCool—Hookah, Shisha, Nargile," Published Nov. 9, 2016, <https://www.sheecool.eu>. (Year: 2016).*
Chemeo, "Chemical Properties of Isopropyl alcohol," Accessed Nov. 19, 2021, <https://www.chemeo.com/cid/24-809-7/Isopropyl%20alcohol>. (Year: 2021).*
Seong; Jai Hoon, "Machine translation of KR 20090115349 A", Translated Jun. 10, 2022, Espacenet.com (Year: 2022).*

* cited by examiner

CHILLING WATER PIPE AND METHOD OF USE

CROSS-REFERENCE TO RELATED APPLICATIONS

This application claims priority to U.S. Provisional Application No. 62/509,039, filed on May 19, 2017. The content of the above application is hereby expressly incorporated by reference herein in its entirety.

FIELD OF DISCLOSURE

The overall field of this invention is a system and method for an apparatus for the inhalation of combustible and vaporizable substances such as tobacco, medicinal herbs, and/or oils. More particularly, the invention is directed to an apparatus by which the smoke or vapor from combusted or vaporized substances may be drawn through water or other liquid and rapidly cooled down by passing through insulated housing containing a cooled substance before being inhaled.

BACKGROUND

Water pipes, hookahs, and other devices used to smoke or vaporize organic materials such as tobacco, medicinal herbs, and/or oils have been used in the Middle East for centuries. Commonly, a water pipe includes a bowl or other reservoir where the organic materials being inhaled are ignited or heated beyond the evaporation point, a water chamber for storing the water, and a mouthpiece so that the smoke or vapor is percolated through the water thus being filtered and cooled. Water pipes are predominately used because they provide a far healthier method of inhalation then the common cigar, cigarettes, or other forms of rolled up tobacco that can irritate a user's air passageways, resulting in severe coughing and hurting the user's throat. This is because the water pipe filters the smoke or vapor through the water so that it does not reach as a high as a combustion level as it would inside of a cigar. Since the substances in the water pipe burn less harshly the water pipe provides a more palatable experience for the user.

To further assist in contributing to a smoother experience for the user, many water pipes are equipped with ice catchers to hold one or more ice cubes to further diminish the heat from the smoke or vapor. This method does have some benefits but may also be dangerous for the user with hot smoke or vapor flowing from the ice cubes creating water vapor collecting in the user's lungs, leading to severe bronchitis and other lung related issues. Thus, there still exists a need for a water pipe or other apparatus that offers an efficient way to rapidly cool down the smoke or vapor.

SUMMARY

Embodiments in the present description are directed to a water pipe including, a base container, the base container having a wall, the wall terminating at an opening, the wall having an inner and outer surface, the wall integrally formed with a bottom, a base insert, the base insert having a wall, the wall having an inner and outer surface, the wall terminating at an opening, the wall integrally formed with a bottom, the base insert configured to hold water, the outer surface of the base insert having a diameter less than the diameter of the inner surface of the base to define a space, a cooling solution positioned within the space between the outer surface of the base insert and the inner surface of the base, a top assembly securable to the base insert, the top assembly configured to cover the opening of the base insert, the top assembly having a downstem, the downstem hollow with an opening at an upper distal end and lower distal end, the downstem configured to extend downward into the base insert when top assembly is secured to base insert.

It is an object of the present description to provide method of inhaling from a water pipe, including the steps of, providing a water pipe: the water pipe having a cylindrical base, the base having a wall, the wall terminating at an opening, the wall having an inner and outer surface, the wall integrally formed with a bottom, a base insert, the base insert having a wall, the wall having an inner and outer surface, the wall terminating at an opening, the wall integrally formed with a bottom, the outer surface of the base insert having a diameter less than the diameter of the inner surface of the base to define a space, a cooling solution positioned within the space between the outer surface of the base insert and the inner surface of the base, the cooling solution absorbing heat from smoke or vapor within the base insert when said cooling solution is cooled, a top assembly securing to the base insert, the top assembly covering the opening of the base insert, the top assembly having a downstem, the downstem hollow with an opening at an upper distal end and lower distal end, the downstem extending downward into the base insert when top assembly is secured to base insert, the top assembly having a mouthpiece, the mouthpiece accepting the mouth of a user, filling the base insert with water wherein the lower distal end of the downstem is submerged in water and the upper distal end is exposed to ambient air, and applying suction at the mouthpiece to draw air through the downstem to percolate through the water in the base insert and out through the mouthpiece.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
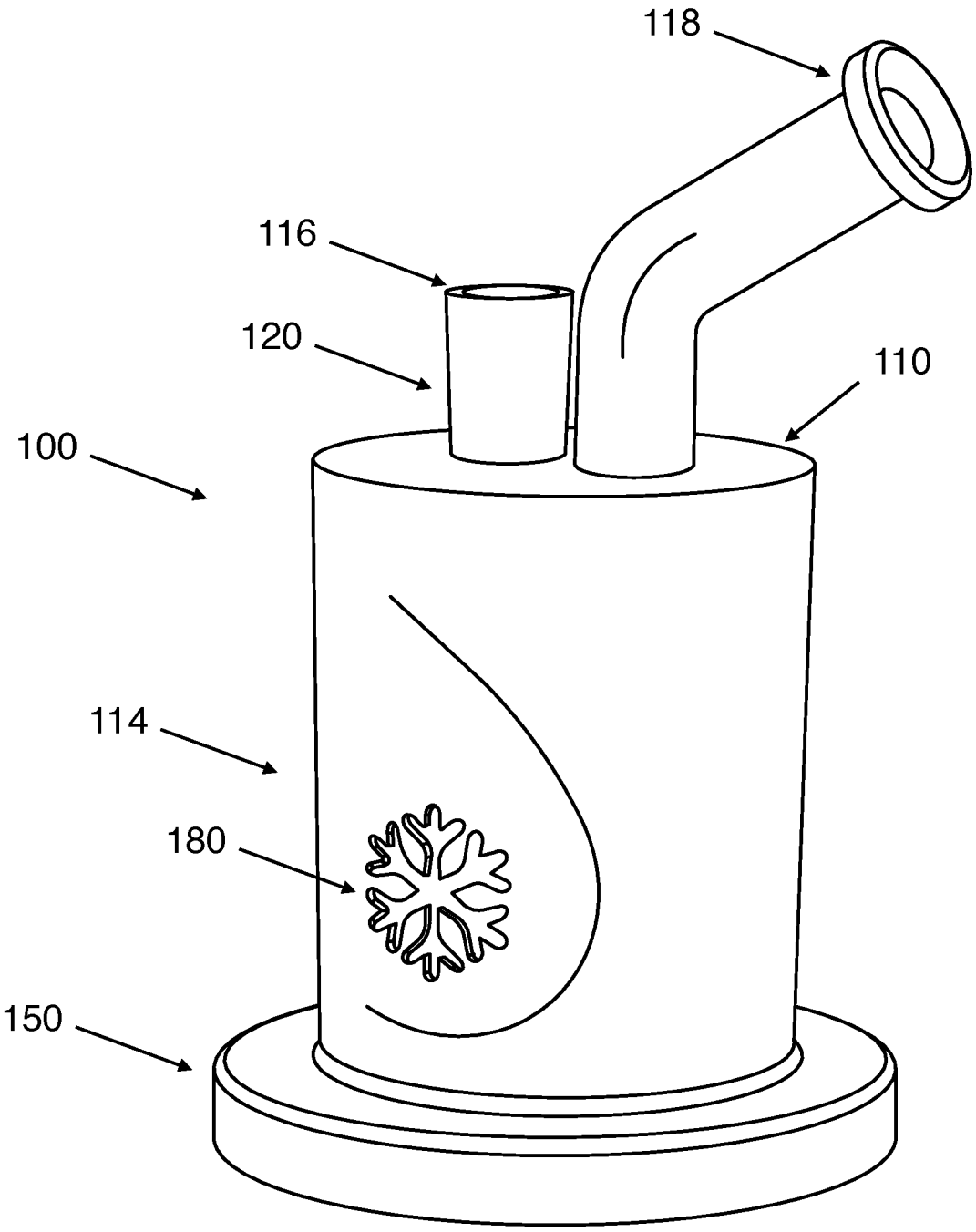
FIG. 1 is an illustration showing a perspective view of the chilling water pipe in assembled state.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure recognizes the unsolved need for a portable water pipe or other type of apparatus that offers an efficient way to rapidly cool down the smoke or vapor produced from ignited or vaporized organic materials (e.g. such as tobacco, medicinal herbs, or oils) associated with the water pipe or other apparatus. In particular, a water pipe as described in one or more embodiments herein may be described as a "chilling water pipe" capable of chilling the smoke or vapor that one may use around or in association with the water pipe.

A water pipe, in one or more embodiments of the present description, may include, without limitation, several components, such as a base container, a base insert, and a top assembly. Further, cooling solution (which is further described below) may be separately poured and stored within the empty space between the outer wall of the base insert and the inner wall of the base container as shown in one or more Figures herein. Initially, the base insert and the base container of the water pipe may be placed in a freezer or other cooling source capable of cooling down the cooling solution. In one or more embodiments, the material of the water pipe prevents thermal shock that glass water pipes often have problems with, as well as makes the water pipe easier to grasp after removing the water pipe from the freezer. The cooling solution remains in a viscous, liquid state and does not freeze at low temperatures like water, such that when the base insert is filled with water and the top assembly is placed or attached to the base insert, the cooling solution acts as a refrigerant to more effectively cool the smoke or vapor being percolated through the chilled water. More details will be provided for the various embodiments in the present description in accordance with the accompanying Figures.

Figure 2:
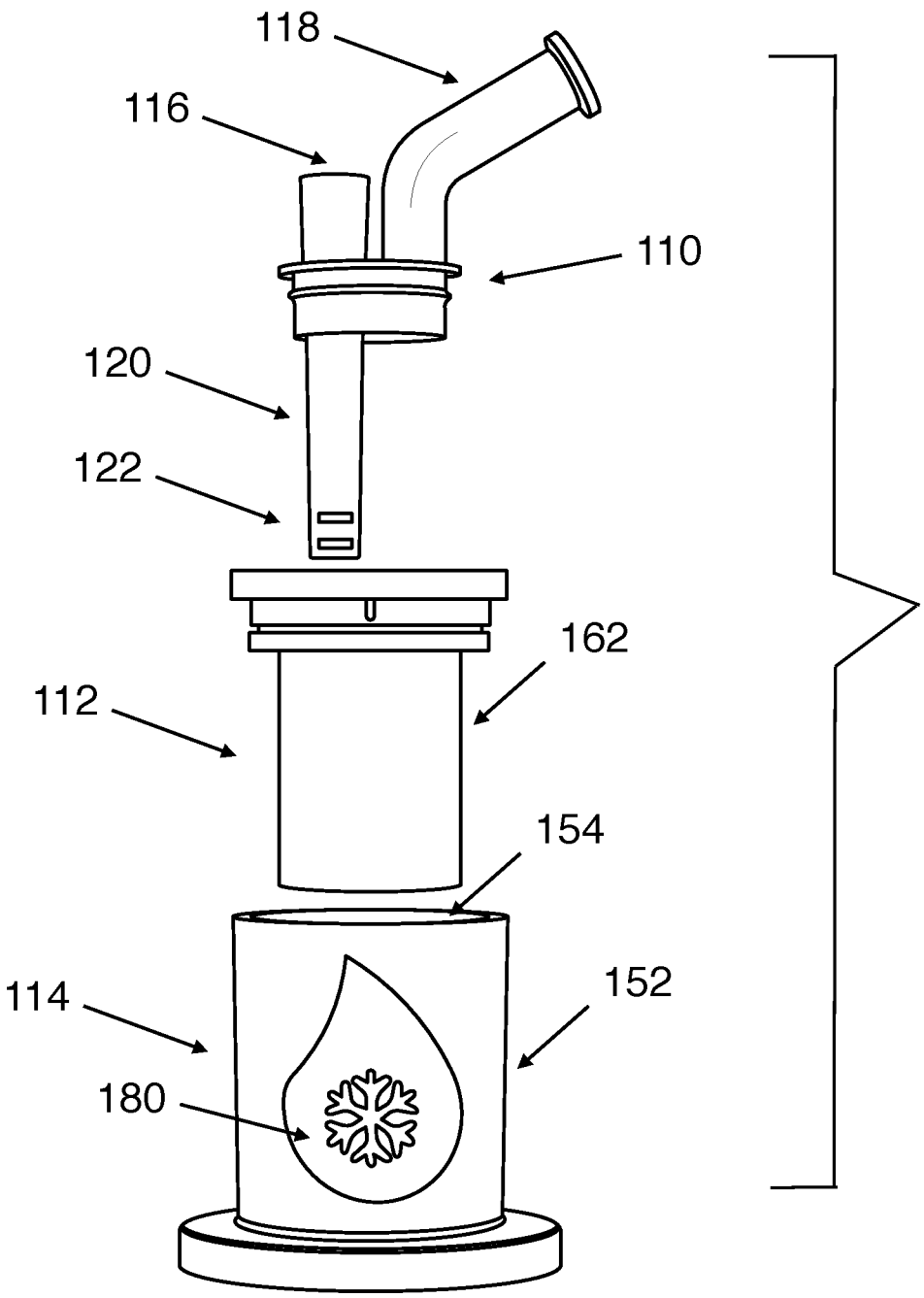
FIG. 2 is an illustration showing an exploded view of an exemplary water pipe, including atop assembly, base container, and base insert.

FIG. 1 depicts a non-limiting embodiment of an exemplary chilling water pipe, such as water pipe 100. FIG. 1 depicts water pipe 100 having base container 114, as well as other components described further below. In FIG. 1, all of the pieces are assembled together. The chilling water pipe may have a design or logo such as design 180 on the outside of water pipe 100. FIG. 2 shows an exploded view of the exemplary, non-limiting components of water pipe 100 as they may fit together. In one embodiment, water pipe 100 includes base container 114. Base container 114, in one or more embodiments, has an outer wall, such as outer wall 152, and an inner wall, such as inner wall 154. Base container 114 is configured to serve as a large container for base insert 112 to be placed into (e.g. whereby base insert 112 either fits wholly within the inner empty space of base container 114 or partially fits within the inner empty space of base container 114). Also, in operation, cooling solution (e.g. such as cooling solution 118 shown in FIG. 3) may be poured into the empty space between the outer wall 152 and inner wall 154 of base container 114. In one embodiment, base container 114 may be cylindrically shaped or any other shape as desired. Base container 114 may also have a bottom stabilizing piece such as bottom stabilizing piece 150 that juts out from each side (e.g. as shown in FIGS. 1-4) and adds further stabilization to water pipe 100. Base container 114 may have an inner chamber or empty space that extends into base container 114 between the inner walls of base container 114. Base container 114 may further include a closed bottom surface as shown in FIG. 1.

As shown in FIG. 2, in one embodiment, base insert 112 may be cylindrically shaped having a hollow cylindrical body with a closed bottom surface. Base insert 112 may be configured, in one or more non-limiting embodiments, to generally have the same shape as base container 114. Base insert 112 may further include an outer wall 162 and an inner wall 164 as well as an inner chamber 166 or opening extending through the empty space of the base insert 112. Further, the inner chamber 166 of base insert 112 may extends downwardly and be defined by the surface of the inner wall 164 of base insert 112. Base insert 112 may also have a closed bottom surface (e.g. circular or cylindrically shaped).

Figure 3:
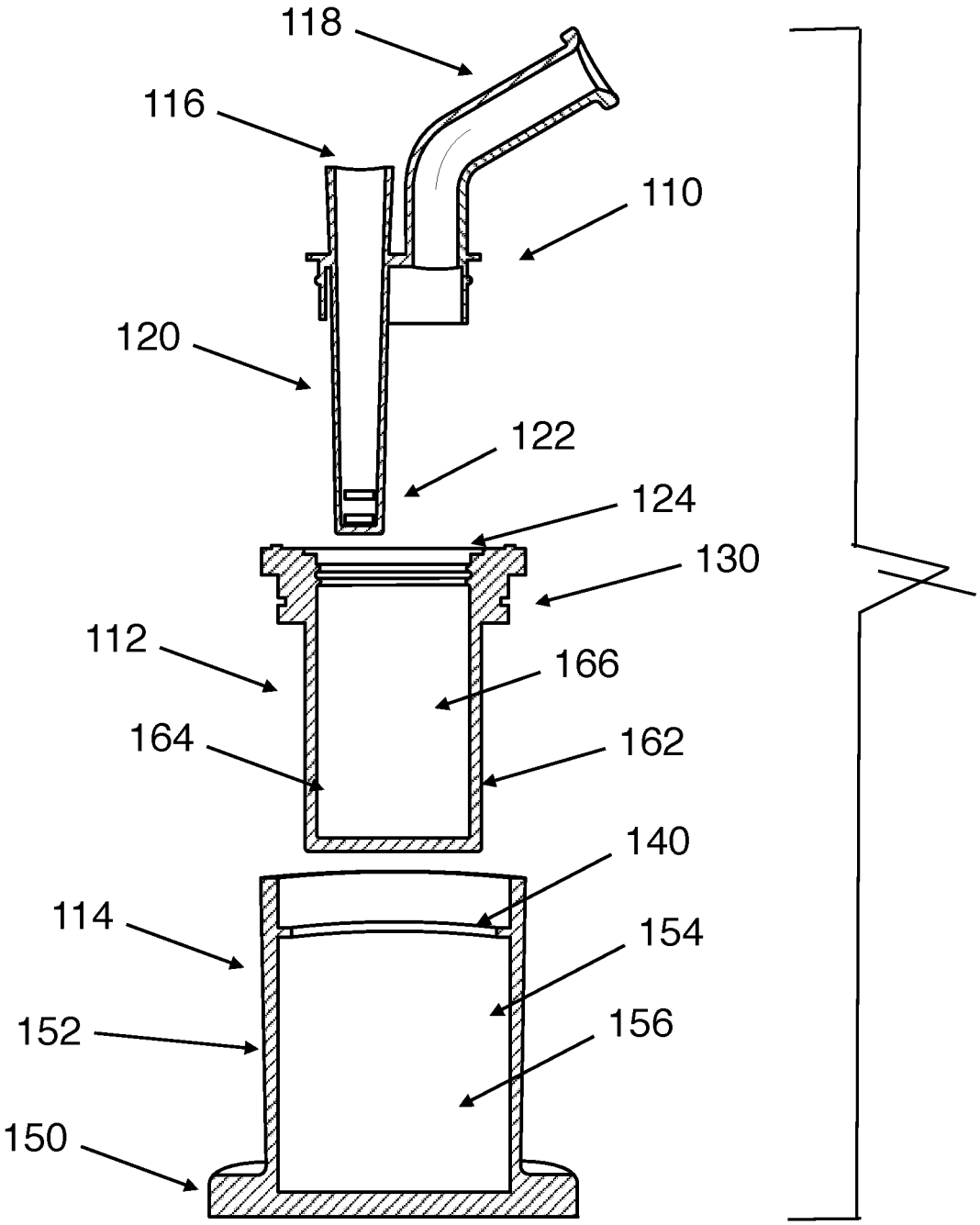
FIG. 3 is an illustration showing a sectional exploded view of the exemplary water pipe.

As shown in FIG. 3, base insert 112 may include a radially extending, flanged, or stepped region, such as flange 130, near the top portion or surface of base insert 112. In one embodiment, flange 130 may have a diameter greater than the diameter of base insert 112. Flange 130 on base insert 112 may be configured to contact and rest against a top surface of base 114 (e.g. across an edge such as edge 140 near the top of base 114) whereby when base insert 112 is positioned inside of base 114, the bottom of base insert 112 does not reach the bottom of base 114. In other embodiments, base insert 112 may be insertable to some predetermined position within base container 114. In one embodiment, base insert 112 is configured to be only partially insertable and positioned within base container 114 such that a bottom surface of base insert 112 does not make contact with an interior bottom surface of base container 114. Flange 130 may be used to position and hang base insert 112 in its correct position within base container 114, although other configurations may also be used that incorporate flange 130 having a different structural appearance or design. In one embodiment, and as further discussed below, water may be poured into an empty inner chamber of base insert 112.

Figure 4:
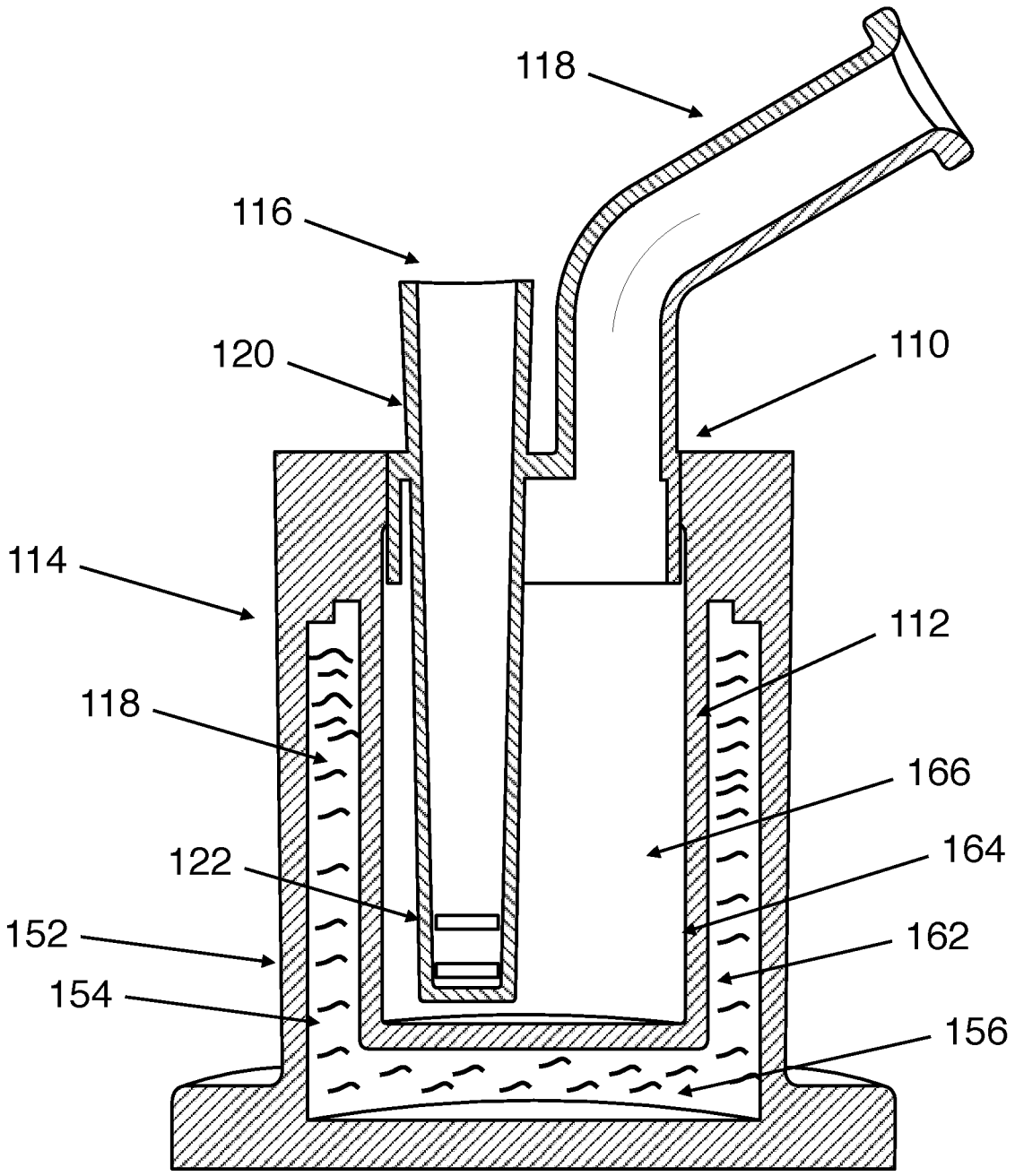
FIG. 4 is an illustration showing a sectional view showing a water pipe in assembled state according to an illustrative embodiment.
Figure 5:
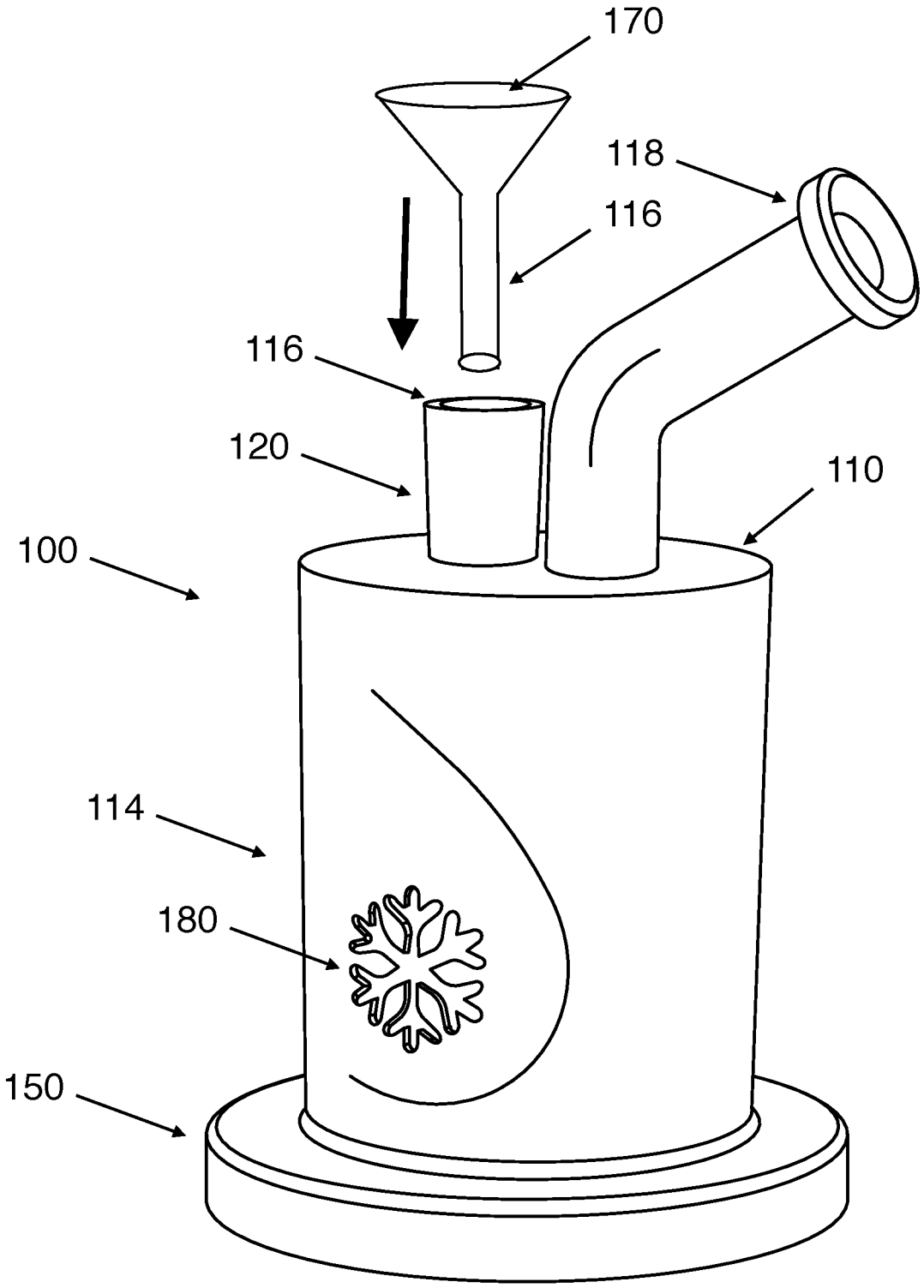
FIG. 5 is an illustration showing a perspective view of a bowl being placed into the chilling water pipe in assembled state.

In one embodiment, before base insert 112 is positioned within base container 114, a cooling solution, such as cooling solution 118, as shown in FIG. 4, may be poured into the empty space between outer wall 152 and inner wall 154 of base container 114. Then, the base container 114 may be separately placed in a freezer or other cooling device in order to cool down cooling solution 118 prior to a user utilizing water pipe 100 to inhale smoke or vapor from combustible substances.

Cooling solution 118 may be a refrigerant or other substance having a higher thermal capacity than frozen water so that cooling solution 118 takes longer to warm up and absorbs more heat for extended amounts of time. Cooling solution 118 may be, without limitation, hydroxyethyl cellulose, polymer, a mixture of rubbing alcohol and water, silica coated with vinyl, or other thermoplastic materials and gels known by those of ordinary skill in the art. Cooling solution 118 is typically non-toxic and biodegradable.

In one embodiment, when base insert 112 is positioned inside of base container 114, a small air space may remain because cooling solution is not filled all the way to the top of base container 114 after cooling solution 118 is poured in to allow for expansion of cooling solution 118 while moving from a fluid to a solid state.

In one embodiment, once cooling solution 118 is poured into its designated empty space between the outer wall 152 and inner wall 154 of base container 114, it may be necessary to affix base insert 112 to base container 114. To affix base insert 112 to base container 114, in one exemplary embodiment, flange 130 of base insert 112 may be spin welded to a designated inner area of base container 114, such as without limitation, the area associated with inner edge 140 of base container 114. Base insert 112 and base container 114 may be affixable together by adhesives (e.g. either permanent or non-permanent adhesives) or any other means of attachment may be used (e.g. Velcro). In some embodiments Base insert 112 and base container 114 may be connected by heat generated by rotational friction at the joint line to weld flange and edge together or may connected by using adhesive or bonding agent. However, those of ordinary skill in the art will appreciate that other means of affixation and/or attachment via permanent or removeable means may be used such as ultrasonic welding, supersonic welding, hot plate welding, linear welding, infrared welding, or laser welding. Alternatively, the base insert 112 may be removably attachable to the base container 114 using any type of fasteners known in the art, including, but not limited to, screws, clips, buckles, nuts and bolts, latches, hinges, or any other type of fasteners.

As seen in FIG. 2, another structural component for water pipe 100 may include top assembly 110. Top assembly 110 may include a downstem, such as downstem 120, and a mouthpiece such as mouthpiece 118, in one exemplary embodiment. In one embodiment, downstem 120 and mouthpiece 118 may be located substantially side by side and joined together on top assembly 110 by a small structural piece. Alternatively, in other embodiments for water pipe 100, downstem 120 may be separate from mouthpiece 118. As shown in an exemplary embodiment in FIG. 3, top assembly 110 may have a substantially circular portion bottom surface having a slightly smaller diameter than the inner diameter opening of base insert 112, thus allowing for centering top assembly 110 over the opening in base insert 112 and thereafter interlocking base insert 112 in engagement with top assembly 110. This engagement applies a radial force inward and may be able to create a substantially air-tight seal that prevents exiting of smoke, vapor, or liquid from base insert 112. Top assembly 110 may be removed by applying a force greater than the radial force, such as a user pulling on top assembly 110 away from base insert 112.

A resilient rubber or other stretchable elastomeric sealing ring such as ring 124 (e.g. as shown in FIG. 3) may be located at a top or substantially near a top surface of base insert 112 to form an air seal between the top assembly 110 and base insert 112 when top assembly 110 is placed over base insert 112. In some embodiments sealing ring 124 may have oppositely disposed protrusions which when top assembly 110 is pulled away from base insert 112 helps to facilitate removal of top assembly 110 by breaking the air tight seal.

As shown in FIG. 3, downstem 120, in one or more non-limiting embodiments, may be tubular in shape that narrows towards the bottom and may have an opening at its first end and a bore extending down through the body of downstem 120.

Further, downstem 120 may further include a percolator, such as percolator 122, at the second end of downstem 120 to provide more air and water to diffuse and cool any smoke or vapor that passes through percolator 122. Percolator 122 may be configured to draw in the air, smoke, or vapor into the water as the user inhales combustible or vaporizable substances, which causes percolation. As the water is percolated the smoke or vapor is filtered.

Downstem 120 may have a joint such as joint 116 at the first end of downstem 120. Joint 116 may have an end that tapers away from, such that joint 116 has a larger diameter at its top surface in order to better conform to a size of a bowl or other apparatus such as bowl 170 (e.g. as shown in FIG. 3) placed into joint 116. Bowl 170 may be designed for holding the organic substances such as tobacco, medicinal herbs and/or oils to be ignited and/or vaporized and inhaled using a water pipe 100.

In one embodiment, downstem 120 extends downward into the empty inner chamber of base insert 112 when top assembly 110 is positioned over base insert 112. Downstem 120 may be of a sufficient length to extend downward into the empty inner chamber of base insert 112. In one embodiment, water may be poured into the empty inner chamber 166 of base insert 112, to a level high enough in base insert 112 such that the opening of the second end of downstem 120 may extend down and be submerged in the water poured into base insert 112.

With respect to mouthpiece 118, mouthpiece 118 may have an open end that is configured to act as an exit for smoke or vapor to move out from. Mouthpiece 118 is configured to be pressed against the mouth of the user, whereby the user may inhale any smoke or vapor from mouthpiece 118.

In one exemplary method of use, cooling solution 118 is poured into the empty space between outer wall 152 and inner wall 154 of base container 114. Base insert 112 may be inserted into base container 114. In one embodiment, to affix base insert 112 to base container 114, base insert 112 may be bonded to base container 114. The combination of the affixed base insert 112 to base container 114 may be referred to herein as "the bottom assembly". The bottom assembly may then be placed in a freezer or other cooling source for a predetermined amount of time to cool cooling solution 118. Once cooling solution 118 has been adequately cooled, a user may remove bottom assembly from the freezer or other cooling source.

Subsequently, water may be poured into base insert 112 through the opening at the top of base insert 112. Top assembly 110 is then placed back onto the top of base insert 112, sealing the water inside. Bowl 170 is then placed onto a top end of downstem 120. Tobacco, medicinal herbs, and/or oils as selected by a user are then placed in bowl 170 and ignited and/or vaporized. When vaporizing a substance such as oil, bowl 170 connected to joint 116 is first heated and then the substance is then added to heated bowl 170 allowing it to vaporize.

User then places their mouth on mouthpiece 118 and inhales, thereby creating a vacuum. Smoke or vapor is drawn down from the ignited or vaporized organic material in the bowl, through downstem 120 (including through percolator 122) and is bubbled through the water located within base insert 112. Because base insert 112 is located within base container 114, the water in base insert 112 is cooled down by the recently chilled cooling solution 118 that exists between the empty space of the inner and outer wall of base container 114. Accordingly, any smoke or vapor that is drawn through or percolated through the water is also cooled. Another benefit is that contaminants from the smoke or vapor may also be removed by this process while also being further cooled. As the user continues to inhale by mouth which is positioned over the open end of mouthpiece 118, the smoke or vapor is eventually drawn up through the bore of the mouthpiece 118 to be inhaled by the user who applies suction to the mouthpiece 118 thereby drawing up the smoke or vapor.

User then may ignite or vaporize additional organic material such as tobacco, medicinal herbs, and/or oil, stored or placed in bowl 170 as long as they desire or until the organic material expires. One end of the combustible or vaporizable, organic material is exposed to ambient air as it is located on the first end of the downstem 120, while the smoke and vapor is able to be drawn through the bore of the downstem 120, through percolator 122, and through the water in base insert 112 before the chilled smoke or vapor travels up through the hollow tube of mouthpiece 118. It is noted that because the cooling solution 118 is chilled prior to the burning process commencing (e.g. by placing the bottom assembly in the freezer or other cooling source), any water located in base insert 112 is also able to be chilled, which helps to chill the smoke or vapor traveling through the water.

User may place more organic material in bowl 170 if they so wish. Once user is finished using water pipe 100, user may then remove top assembly 110 from base insert 112 and pour out any water located within base insert 112's inner chamber. User may then clean water pipe 100 by hand washing or other methods known by those skilled in the art, replace top assembly 110 onto base insert 112 and store for subsequent use.

The one or more embodiments described above provide for a portable, chilling water pipe that may be useful to chill the smoke or vapor that a user may want to inhale from organic, combustible and/or vaporizable materials. The overall process provides a relatively quick way for the user to chill any such smoke or vapor, which if not chilled, may cause burns or other damage to a user. Another advantage of the one or more embodiments described herein is that some unwanted contaminants may be removed via the exemplary process described above. Those of ordinary skill in the art can image that other benefits and applications may be also stem from the one or more embodiments provided in the present description.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the above claims.

What is claimed is:

1. An apparatus comprising:

a base container having a continuous outer wall that is cylindrical in shape extending directly upward, an inner wall, an outer wall, a top opening, and a closed bottom surface, wherein the base container further comprises a base container inner chamber defined by the inner wall of the base container;

a base insert permanently affixed to the base container, wherein the base insert has an outer wall, an inner wall, a top opening, and a closed bottom surface, wherein the base insert further comprises an empty base insert inner chamber defined by the inner wall of the base insert wherein a top surface of the base insert extends above the base container, wherein an outer circumference of the top surface is aligned with the outer wall of the base container, wherein the base insert and the base container are made of material that is not glass wherein the material prevents thermal shock when positioned inside a cooling source;

wherein an outer cavity is formed between the inner wall and the closed bottom surface of the base container and the outer wall and the closed bottom surface of the base insert wherein an inner cavity within the inner wall of the base insert is separate from a first cooling solution;

the first cooling solution positioned within the outer cavity wherein the first cooling solution is positioned within the outer cavity before the base insert is affixed to the base container through the top opening of the base insert;

a top assembly securable to the base insert, the top assembly configured to cover the top opening of the base insert, wherein the top assembly further comprises a downstem and a mouthpiece, wherein the downstem has a hollow inner bore with a first opening at a first end and a second opening at a second end of the downstem, wherein a second cooling solution is configured pourable into the inner cavity when the top assembly is removed; and the second cooling solution positioned within the inner chamber of the base insert separate from the first cooling solution which circles around the second cooling solution wherein the second cooling solution is configured to be chilled by the first cooling solution that has been placed in the freezer or other cooling source, wherein when the top assembly is secured to the base insert the downstem is positioned into the empty base insert inner chamber wherein the base container has a cylindrical bottom stabilizing piece wherein an entirety of the cylindrical bottom stabilizing piece is below the outer wall of the base container, wherein the cylindrical bottom stabilizing piece is integrally formed and surrounds a circular bottom of the base container to provide further stabilization wherein the outer cavity extends downward past the continuous outer wall into the cylindrical bottom stabilizing piece, wherein the inner cavity does not extend downward past the continuous outer wall into the cylindrical bottom stabilizing piece.

2. The apparatus of claim 1, wherein the base insert further comprises a flange extending along the top surface of the base insert, wherein the flange is circular and a bottom of the flange rests upon a circular edge positioned inward from the inner wall of the base container wherein the circular edge is positioned below the top opening, and further wherein the base insert is positioned within the base container wherein the closed bottom surface of base insert is not in contact with the closed bottom surface of the base container.

3. The apparatus of claim 1, wherein the base container and the base insert are substantially similar in shape, wherein the base insert is smaller in size than the base container and configured to fit within the base container, wherein when the top assembly is secured to the base insert the downstem does not come into contact with the first cooling solution or the outer cavity.

4. The apparatus of claim 1, wherein the first cooling solution is a refrigerant, the first cooling solution having a higher thermal capacity than frozen water, wherein the first cooling solution is hydroxyethyl cellulose, non-toxic, and biodegradable.

5. The apparatus of claim 1, wherein the base insert further comprises a seal with a sealing ring, the seal configured to produce a substantially air tight seal between the top assembly and the base insert when top assembly is secured to the base insert, wherein the sealing ring has one or more oppositely disposed protrusions.

6. The apparatus of claim 1, wherein the top assembly is configured to be removable from the base insert, wherein the top assembly has a circular portion bottom surface having a smaller diameter than an inner diameter opening of the base insert such that the top assembly is removably fastened to the base insert wherein the top assembly fits directly on top of the base insert.

7. An apparatus comprising:

a cylindrical base container having a continuous cylindrical outer side wall extending directly upward, an inner side wall, a top opening, and a closed inner bottom wall, wherein the base container further comprises a base container inner chamber defined by the inner side wall of the base container;

a cylindrical base insert, wherein the base insert is permanently affixed to the base container, wherein the base insert has an outer side wall, an inner side wall, a top opening, and a closed inner bottom wall, wherein the base insert further comprises an empty base insert inner chamber defined by the inner side wall of the base insert; wherein the base insert is smaller in size than the base container and is positioned within the base container, wherein the inner bottom wall of the base insert does not make contact with the inner bottom wall of the base container, wherein an outer cavity is formed between the inner side wall and the inner bottom wall of the base container and the outer side wall and the inner bottom wall of the base insert;

a first cooling solution positionable within the outer cavity, the first solution having a higher thermal capacity than frozen water; and a top assembly securable to the base insert, the top assembly configured to cover the top opening of the base insert, the top assembly having a circular disc portion with a circular disc top extending down into a hollow circular disc bottom, the hollow circular disc bottom extending downward into the base insert, wherein the top assembly further comprises a single downstem and a mouthpiece, the mouthpiece having a first end of larger area than a body of the mouthpiece, the first end having an opening for inhalation by a user; the mouthpiece extending vertically above the downstem with a bottom vertical portion and an top angled portion angling outward from the apparatus, wherein the downstem is vertically aligned and extends above, below, and through the circular disc top and has a hollow inner bore with a first opening at a first end and a second opening at a second end of the downstem wherein the second end of the downstem extends downward, the first end of the downstem forming a joint configured to receive a bowl placed over the first opening, the joint has a larger diameter at its top surface in order to better conform to a size of the bowl, wherein the bowl is configured to hold a substance to be combusted or vaporized, wherein the base insert and the base container and the top assembly are made of material that is not glass wherein the material prevents thermal shock when positioned inside a cooling source wherein the base container has a cylindrical bottom stabilizing piece wherein an entirety of the cylindrical bottom stabilizing piece is below the outer wall of the base container, wherein the cylindrical bottom stabilizing piece is integrally formed and surrounds a circular bottom of the base container to provide further stabilization wherein the outer cavity extends downward past the continuous cylindrical outer side wall into the cylindrical bottom stabilizing piece, wherein an inner cavity within the inner wall of the base insert does not extend downward past the continuous cylindrical outer side wall into the cylindrical bottom stabilizing piece.

8. The apparatus of claim 7, the base insert configured to receive a second cooling solution poured into a second cavity in the inner chamber of the base insert separate from the first cooling solution wherein the second cooling solution is configured to be chilled by the first cooling solution that has been placed in the cooling source, wherein when the second cooling solution is poured into the inner chamber of the base insert the second end of the downstem and the top assembly is secured to the base insert the downstem is positioned in the second cooling solution, wherein the downstem is tubular in shape and narrows towards the second end.

9. The apparatus of claim 8, wherein the base insert further comprises a flange extending along a top wall of the base insert, wherein the flange is configured to hold the base insert in place and in contact with the base container, wherein the flange is circular and a bottom of the flange rests upon a circular edge surface positioned inward from the inner wall of the base container wherein the circular edge is positioned below a top of the base container, and further wherein the base insert is configured to be positioned in place within base container without the inner bottom wall of base insert making contact with the inner bottom wall of the base container, wherein the base insert and the base container are connected by adhesive.

10. The apparatus of claim 9, the base container having an indented logo on the cylindrical outer side wall.

* * * * *